United States Patent [19]

Masure et al.

[11] 4,060,474

[45] Nov. 29, 1977

[54] ELECTROLYTIC CELL OF THE DIAPHRAGM TYPE COMPRISING A BASE MADE OF AN INSULATING MATERIAL

[75] Inventors: Daniel Masure, Lavera; Jacques Guillaumont, Saint-Auban; Jean-Marie Pigeaud, Lavera, all of France

[73] Assignee: Rhone-Poulenc Industries, Paris, France

[21] Appl. No.: 661,531

[22] Filed: Feb. 26, 1976

[30] Foreign Application Priority Data

Feb. 26, 1975 France ..... 75.05963

[51] Int. Cl.[2] ..... C25B 1/16; C25B 1/26; C25B 9/02

[52] U.S. Cl. ..... 204/270; 204/252; 204/269; 204/279; 204/286

[58] Field of Search ..... 204/95, 98, 128, 252, 204/253, 256, 258, 266, 263, 286, 288, 270, 269

[56] References Cited

U.S. PATENT DOCUMENTS

| | | | |
|---|---|---|---|
| 1,368,206 | 2/1921 | Burdett | 204/5 |
| 1,555,424 | 9/1925 | Luening | 204/129 X |
| 3,342,717 | 9/1967 | Leduc | 204/266 X |
| 3,432,422 | 3/1969 | Currey | 204/258 |
| 3,498,903 | 3/1970 | Kamarjan | 204/286 X |
| 3,591,483 | 7/1971 | Loftfield et al. | 204/252 |
| 3,642,604 | 2/1972 | Giacopelli | 204/286 |
| 3,891,531 | 6/1975 | Buoy et al. | 204/263 |
| 3,928,167 | 12/1975 | Buoy et al. | 204/286 |

*Primary Examiner*—Arthur C. Prescott

[57] ABSTRACT

An electrolytic cell of the diaphragm type, for electrolysis of alkali chlorides, is provided having a base comprising an insulating material with the said anode extensions passing through it, connecting means are connected to at least one current cooling bar, and a rigid structure with the distributing bar and the base of the cell resting on it, the bar being disposed between the base of the cell and the rigid structure.

3 Claims, 2 Drawing Figures

Figure 1:
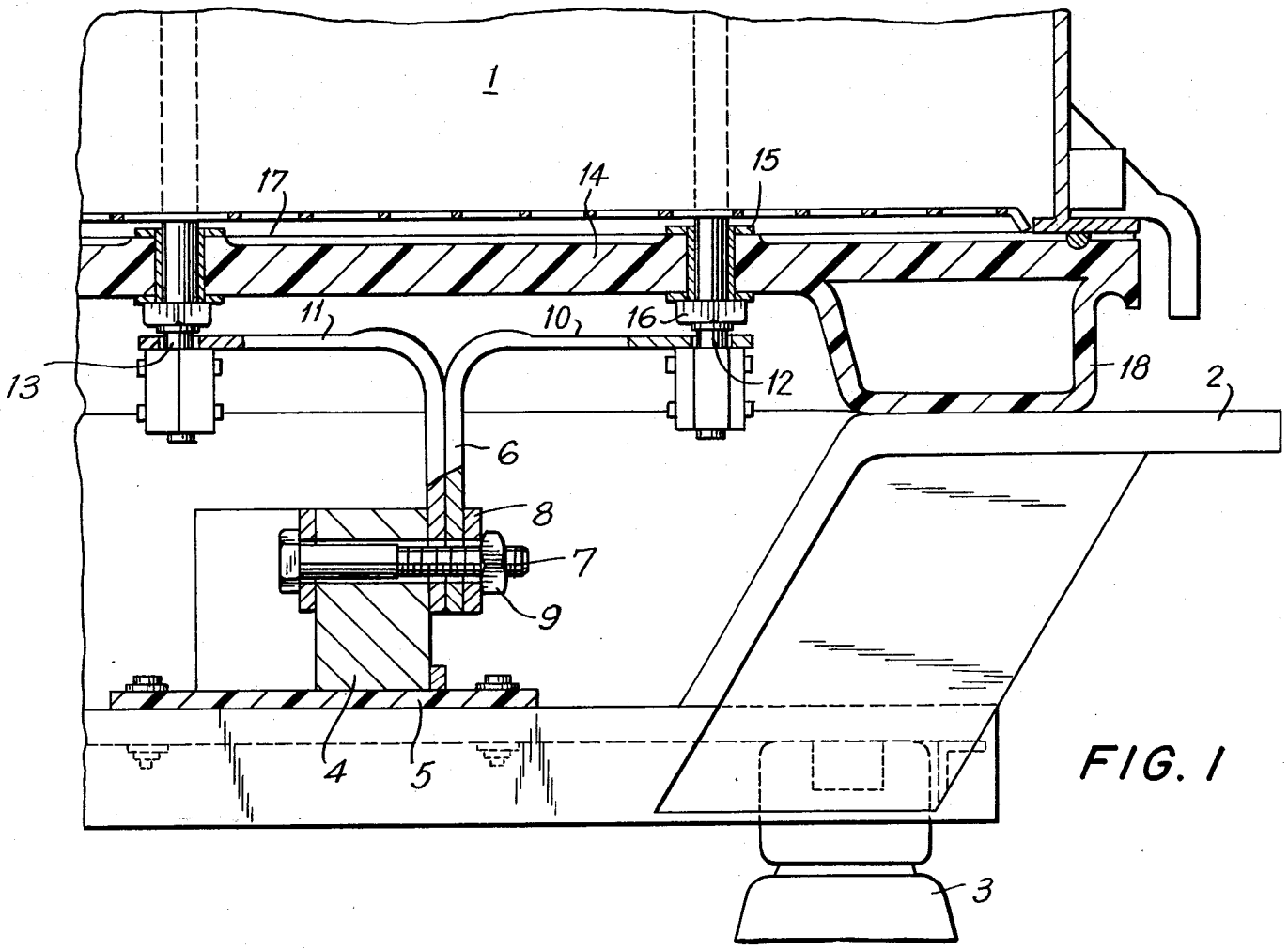

ELECTROLYTIC CELL OF THE DIAPHRAGM TYPE COMPRISING A BASE MADE OF AN INSULATING MATERIAL

BACKGROUND OF THE INVENTION

The invention relates to a new electrolytic cell of the diaphragm type. More particularly, it concerns a diaphragm-type cell with vertical anodes rigidly connected to an electrically non-conductive base, for electrolyzing aqueous solutions of alkali chlorides.

In order to obtain improved current distribution it has long been proposed to make use of a current intake to one electrode, in an electrolytic cell, with a uniform current density, e.g., as in U.S. Pat. No. 1,368,206 or U.S. Pat. No. 1,555,424. A current distributor of this type is rectangular in shape.

It has also been proposed, in U.S. Pat. No. 3,432,422, that the anodes should be fixed vertically in a lead matrix; that the intake and distribution of the current should be provided for by bus bars made of copper, each bar being axially centered relative to a bed of anodes; and that the bar should be triangular in shape in order to give uniform current density.

However, it is well known that an electrolytic cell must fulfill several types of requirements. Firstly, the liquor to be electrolyzed is particularly corrosive in the case of aqueous solutions of alkali chlorides, such as sodium chloride. In addition, the anodes must be mounted in a particularly impervious manner.

Furthermore, more and more metal anodes are being used in electrolytic cells, since these have the advantage of having great dimensional stability with the passage of time. This advantage allows for maximum reduction of the inter-polar distance between anode and cathode but consequently entails mechanically very rigid mounting of the anodes.

For reasons of upkeep and maintenance, it is also necessary to have the fixing means easily accessible, so that the anodes may readily be replaced.

It has, therefore, already been proposed, in French Pat. No. 1,600,249 and its patent of addition (No. 2,164,495), to use vertical, plane and hollow anodes which, in the case of at least one of their two parallel faces, are formed by a perforated sheet or a grating made from titanium, a similar metal or an alloy of such metals; the anodes are fixed on the base of the cell of extensions which pass through the base; the extensions comprise a core made of a highly conductive metal and covered with a sheath of titanium, a similar metal or an alloy of such metals, and good electrical contact is provided between the sheath and the core.

However, although this proposal provides for good passage of current into the electrode itself and for good positioning of the electrode, it provides no remedy for the other drawbacks mentioned above.

The present invention aims to provide a new arrangement of the cell components which, apart from good current distribution with minimum leakage, will provide for an anode assembly which is stable and reliable with the passage of time, readily accessible and of excellent imperviousness.

It is, accordingly, an object of the present invention to provide an electrolytic cell of the diaphragm type which overcomes the drawbacks of the prior art.

It is also an object of the present invention to provide an electrolytic cell having an anode assembly which is stable, reliable, readily accessible and of superior imperviousness to corrosion.

Figure 2:
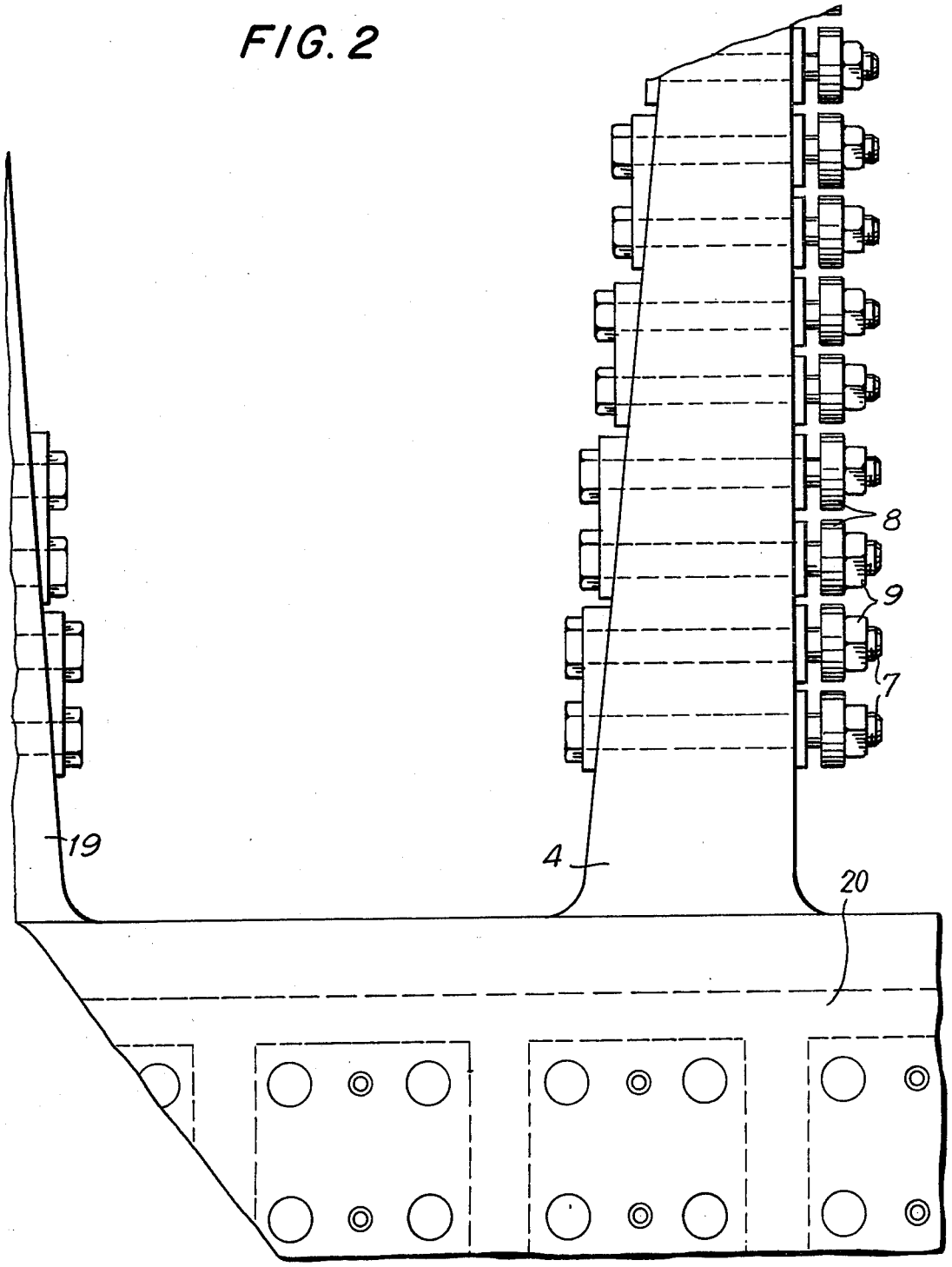

Other objects will be apparent to those skilled in the art from the present description, and the appended drawings, in which:

FIG. 1 is a partial sectional elevation of a cell in accordance with the present invention, and, FIG. 2 is a plane view illustrating the current distributing elements and the method of fixing the connections, referred to herein, by bunches of copper foils.

GENERAL DESCRIPTION OF THE INVENTION

The subject matter of the invention is a new electrolytic cell of the diaphragm type, comprising a plurality of anodes which are fixed to the base of the cell by means of extensions which pass through the base, the extensions comprising at least one core made of a metal which is a good conductor of electricity. It is characterized in that the base is made of an insulating material which is chemically inert or is made chemically inert and which is responsible for positioning and insulating the electrolytically active portion and for making it impervious; that the core of conductive metal is connected by conducting means to at least one current distributing bar; and that the bar is fixed on a rigid structure which has at least the distributing bar and the base of the cell resting on it, the bar being disposed between the base of the cell and the rigid structure.

The base may be made of any chemically inert, insulating and mechanically resistant material, such as a polyester resin.

The rigid structure is itself insulating or insulated. It may, e.g., be made of concrete or comprise metal, e.g., steel, components which are insulated.

In a preferred embodiment of the invention, the rigid structure comprises a bowl-shaped insulated metal frame, resting on supports and with at least one equipotential distributing bar resting on it by way of insulating elements, the bar being connected to the anode extensions by means of bunches of flexible foils made of copper.

It is advantageous for each said bunch to be divided into two branches and to supply two anodes, with their axes located in one and the same vertical plane.

In a preferred embodiment of the invention, the current distributing bars are extended by a platform located in front of the cell, from which the connection between cells is provided in a very simple manner, e.g., by means of bunches of foils connecting the anodic portion to the cathodic distributing elements of the next cell.

Further according to the invention, a component may be provided to extend the said platform laterally and to act as a short-circuiting component.

SPECIFIC DESCRIPTION OF THE INVENTION

In order to disclose more clearly the nature of the present invention, the following example illustrating the invention is given. It should be understood, however, that this is done solely by way of example and is intended neither to delineate the scope of the invention nor limit the ambit of the appended claims.

EXAMPLE

Referring now to FIG. 1, a cell 1 is placed on a rigid metal structure 2 which rests on feet 3. Bars 4 for equipotential distribution of current are fixed on the rigid structure 2 by way of an insulating element 5 made, e.g., of polyester resin. Bunches of copper foils 6 are fixed on the bar 4 by means of threaded rods 7, discs 8, and nuts 9.

Each bunch 6 is divided into two branches 10 and 11, which are connected to extensions of anodes 12 and 13.

Each anode 12 and 13 is positioned on an insulating base 14 made of polyester by means of a disc 15 and a nut 16.

A chemically inert coating 17, e.g., of titanium, makes the electrolytically active part of cell 1 impervious to chemical corrosion by the electrolyte.

Insulating base 14 rests on rigid structure 2 by means of seatings 18.

As can be seen from FIG. 2, a plurality of bars 4 and 19 are rigidly connected to a front plate 20 which provides the electrical connection between two consecutive cells.

As shown by the foregoing example, the invention allows for a simple arrangement of the elements relative to one another; it makes the mounting of the anodes very accessible and fulfills all the desired electrical, chemical and mechanical requirements.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. An electrolytic cell of the diaphragm type, comprising, in combination, a base of an electrically insulating material, a plurality of anodes fixed on said base of said cell by means of extensions of said anodes which pass through said base, said extensions comprising at least one core of a metal which is a good electrical conductor, connecting means connected to at least one of a plurality of current distributing bars, and a rigid structure with the distributing bar and the base of the cell resting thereon, said distributing bars being disposed between said base of said cell and said rigid structure, said plurality of current distribution bars being extended by a platform located in front of said cell, from which electrical connection between cells is provided, said rigid structure resting on supports and with at least one said current distributing bar resting on said rigid structure by means of an insulating element.

2. An electrolytic cell according to claim 1, wherein said electrical connection between cells is provided by means of bunches of foils.

3. An electrolytic cell according to claim 1, wherein said cell also comprises a component which extends the said platform laterally and acts as a short-circuiting component.

* * * * *